United States Patent [19]

Robertson et al.

[11] 4,295,901

[45] Oct. 20, 1981

[54] METHOD OF IMPARTING A FINE GRAIN STRUCTURE TO ALUMINUM ALLOYS HAVING PRECIPITATING CONSTITUENTS

[75] Inventors: Wayne M. Robertson; John A. Wert, both of Thousand Oaks, Calif.

[73] Assignee: Rockwell International Corporation, El Segundo, Calif.

[21] Appl. No.: 91,234

[22] Filed: Nov. 5, 1979

[51] Int. Cl.[3] ..... C22F 1/04

[52] U.S. Cl. ..... 148/12.7 A

[58] Field of Search ..... 148/12.7 A

[56] References Cited

U.S. PATENT DOCUMENTS 4,092,181 5/1978 Paton et al. ..... 148/12.7 A

*Primary Examiner*—R. Dean

*Attorney, Agent, or Firm*—H. Fredrick Hamann; Craig O. Malin

[57] ABSTRACT

A method is provided to impart a fine grain structure to aluminum alloys which have precipitating constituents. The alloy is overaged to form coarse precipitates, and then plastically deformed at least 40%. Deformation is accomplished at a temperature above the alloy's recrystallization temperature and below its solvus temperature at a sufficiently high rate to introduce strain energy into the alloy before complete recovery can occur. The alloy is subsequently held at a recrystallization temperature to form a new fine grain structure.

5 Claims, No Drawings

METHOD OF IMPARTING A FINE GRAIN STRUCTURE TO ALUMINUM ALLOYS HAVING PRECIPITATING CONSTITUENTS

BACKGROUND OF THE INVENTION

1. Field of the Invention

This invention relates to the field of metallurgy, and particularly to the field of processing precipitation hardening aluminum alloys.

2. Description of the Prior Art

A fine grain size tends to improve the mechanical properties of most structural materials. Additionally, formability can be improved by elimination of "orange peel" structure, and superplasticity realized in many alloys by providing a fine grain structure. For alloys which are susceptible to stress corrosion cracking such as many precipitation hardening aluminum alloys, a fine grain structure generally decreases the susceptibility to stress corrosion. However, grain refinement is difficult to achieve in aluminum alloys, and most attempts to obtain a fine grain size by conventional mechanical working and recrystallization by heating have only resulted in the material recrystallizing to the original coarse grain size with large "pancake" shaped grains.

U.S. Pat. No. 4,092,181 to Paton and Hamilton describes a method of imparting a fine grain to precipitation hardening aluminum alloys. Patent Application Ser. No. 62,203 filed July 30, 1979 by Hamilton, Mahoney, and Paton, now U.S. Pat. No. 4,222,797 describes an improvement in the earlier method which utilizes an increased rate of forming to obtain even finer grains. According to both these prior methods, the aluminum alloy is mechanically worked below its recrystallization temperature and then heated to above the recrystallization temperature. These prior methods work well for sheet and thin plate which can be heated rapidly to above the recrystallization temperature. However, heavy plate and large bars heat up slowly because of their mass, and the worked material may recover before the recrystallization temperature is reached. Consequently, expensive, fast heat up procedure such as the use of molten salt and lead baths are required to obtain fine grain in heavy sections of aluminum.

SUMMARY OF THE INVENTION

It is an object of the invention to provide an improved method for refining the grain size of aluminum alloys containing precipitation hardening constituents.

It is an object of the invention to provide a method for refining the grain size of heavy sections of aluminum alloys without requiring rapid heating to the recrystallization temperature.

It is an object of the invention to improve properties of precipitation hardening aluminum alloys by providing an improved method to refine the grain size.

It is an object of the invention to improve the formability of precipitation hardening aluminum alloys by providing an improved method of refining the grain size.

It is an object of the invention to improve the forgeability of precipitation hardening aluminum alloys by providing an improved method of refining the grain size.

According to the invention, a method is provided for imparting a fine grain structure to aluminum alloys which have precipitating constituents. The alloy is first heated to a solution treating temperature to dissolve the precipitating constituents in the alloy. The alloy is then cooled, preferably by water quenching, to below the solution temperature and then overaged to form a uniform distribution of small precipitates by heating it above the precipitation hardening temperature for the alloy but below its solution treating temperature. Strain energy is introduced into the alloy by plastically deforming it in a temperature range above its minimum recrystallization temperature and below its solvus (approximately 600° F. to 940° F.) to reduce its cross-sectional area a total of 40% minimum, the deformation occuring at a sufficient rate to retain at least some of the strain energy at the end of the deformation step. The alloy is subsequently held at a recrystallization temperature so that new grains are nucleated by the overaged precipitates and the growth of these grains provides a fine grain structure.

In a preferred embodiment, the alloy is heated at the recrystallization temperature while it is still hot from the plastic deforming step.

These and other objects and features of the present invention will be apparent from the following detailed description.

DESCRIPTION OF THE PREFERRED EMBODIMENT

According to the invention, the alloy is first solution treated in the conventional way, as would be done prior to precipitation hardening. In this condition the structure of the alloy is coarse-grained and the precipitating constituents are in solid solution. Instead of being followed by the standard precipitation hardening treatment (a low temperature aging treatment to produce a fine distribution of precipitates spaced 100 to 500 Å apart suitable for increasing the strength of the alloy), the material is subjected to a high temperature precipitation treatment, called overaging, which produces a somewhat coarser distribution of precipitates spaced ~5,000 to 10,000 Å apart, as described in U.S. Pat. No. 4,092,181.

Next, the material is mechanically worked (plastically deformed) to provide lattice strain necessary for recrystallization. As known in the industry, plastic deformation can be accomplished by rolling, by extrusion, by drawing, and by forging to produce various products such as plate, bar, sheet, wire, forgings, etc.

An important feature of the invention is the requirement that the plastic deformation be accomplished at a temperature above the minimum recrystallization temperature of the alloy, namely in the range of approximately 600° F. to 940° F. Earlier investigators taught that the plastic deformation had to take place at a relatively low temperature (typically less than 450° F.), because at higher temperatures recovery and recrystallization during the deformation operation removed, or annealed out, the strain energy. According to prior teaching it was then necessary to heat the strained material to a higher temperature in order to cause recrystallization. If the heating operation was slow, then the material recovered before the recrystallization temperature was reached and the material would not recrystallize to a fine grain. This was a problem with thick plate and heavy bars and forgings which heat slowly because of their large mass. Consequently, molten salt or lead baths were sometimes required to rapidly heat thick sections to the recrystallization temperature.

In work leading to the present invention it was discovered that strain energy can be introduced into aluminum alloys by plastically deforming the material at temperatures above the minimum recrystallization temperature. By deforming the material at a sufficiently high rate, strain energy can be created in the alloy faster than it is being removed by recovery and recrystallization. For temperatures in the range of 600° F. to 940° F., the rates of reduction achieved by laboratory and production rolling mills are sufficient to practice the invention provided that a large reduction in area is accomplished in a single pass through the rolls.

In addition to eliminating the subsequent heat up problem, the higher temperature used during forming makes it easier to work the material. This is a particular advantage for forgings, because the forgings can be finished at higher temperatures where the material is softer and easier to form.

Finally, the worked material is recrystallized by heating it above the recrystallization temperature but below its solidus temperature at which time new grains are nucleated at or around the precipitates formed during the previous overaging treatment. It also appears that these precipitates act to retard further grain growth.

Experiments were conducted on samples of 7075 aluminum alloy and on 2219 aluminum alloy to determine the reduction in grain size which could be accomplished using various combinations of rolling temperatures and amounts of reduction. In all experiments the starting material had large pancake shaped grains averaging about 30 μm thick and 300 μm in diameter. After treatment, the recrystallized grains were smaller and much more equiaxed.

The following examples are illustrative of the experiments and of the invention as applied to precipitate hardening aluminum alloys of different compositions.

EXAMPLE 1

Aluminum Alloy 7075

A ¼ inch thick sample of 7075 aluminum alloy was solution treated in the standard range of 860° F. to 930° F. (actually 900° F. for this sample) for 3 hours and water quenched to maintain the precipitate in solution. The alloy was then overaged at 750° F. for about 8 hours. This treatment produced a distribution of relatively coarse precipitates suitable for obtaining a fine grain structure during a subsequent recrystallization treatment.

The overaged alloy was then plastically deformed at a temperature above its minimum recrystallization temperature but below its solvus temperature. For 7000 series aluminum alloys such as 7075, this is a temperature within the range of approximately 705° F. to 800° F. The sample used for Example 1 was hot rolled at the same temperature (750° F.) used for overaging and then cooled by water quenching. Hot rolling consisted of reducing the cross sectional area of the hot sample 75% by passing it once between the rolls of a laboratory rolling mill.

The sample was then heated to 900° F., held at that temperature for ½ hour to recrystallize it, and then water quenched to cool it. The resulting grain structure was substantially equiaxed and the grain averaged about 9–11 μm in diameter.

EXAMPLE 2

Aluminum Alloy 7075

A bar of 7075 aluminum alloy was solution treated and overaged as described above for Example 1. The bar was then heated to a temperature in the range of 705° F. to 800° F. and plastically deformed by reducing its cross sectional area 40% during one pass through a rolling mill.

The hot worked bar was transferred to an oven while still hot and held at a temperature in the range of 705° F. to 930° F. for about 2 hours. The resulting grain structure was substantially equiaxed and averaged about 14 μm in diameter.

EXAMPLE 3

Aluminum Alloy 7075

A bar of 7075 aluminum alloy was processed as described in Example 2 except it was passed twice through the rolling mill. Its cross sectional area was reduced 50% during each pass for a total reduction of 75%. Between passes, while the rolls were being set for the second pass, the bar was held in a furnace so that its temperature was in the range of 705° F. to 800° F. during the entire rolling process.

After recrystallization, the bar had a grain structure consisting of substantially equiaxed grains which averaged about 10 μm in diameter.

EXAMPLE 4

Aluminum Alloy 2219

A bar of 2219 aluminum alloy was solution treated in the standard range of 985° F. to 1005° F. for 3 hours and then water quenched to maintain the precipitate in solution. The alloy was then overaged at 750° F. for about 8 hours. This treatment produced a distribution of relatively coarse precipitates suitable for obtaining a fine grain structure during a subsequent recrystallization treatment.

The strain energy necessary for recrystallization was introduced into the overaged bar by heating it to 825° F. and passing it between a pair of rolls that were set to reduce its cross sectional area by 70% in a single pass.

The hot rolled bar was recrystallized by heating it to 850° F. for 1 hour to produce a fine grain structure having an average grain size of approximately 10 μm.

EXAMPLE 5

Aluminum Alloy 2014

The following treatment is an example of the invention as applied to a 2000 series aluminum alloy such as 2014.

A bar of 2014 aluminum alloy is solution treated within the standard solution temperature range of 925° F. to 945° F. and rapidly cooled to maintain the precipitating elements in solution. Next, the alloy is overaged above its normal aging temperature (for example, 845° F. for 8 hours) to produce coarse precipitates.

The overaged alloy is plastically deformed a minimum of about 40% at a temperature above its recrystallization temperature but below its solvus temperature in the range of 705° F. to 900° F. The deformation should be accomplished at conventional rolling speeds or faster, and at least 25% of the total reduction should be accomplished in a single pass through the rolls.

Recrystallization of the deformed alloy to a fine grain structure is accomplished by holding it at a temperature in the range of 705° F. to 960° F. for ½ to 4 hours.

EXAMPLE 6

Aluminum Alloy 6061

The following treatment is an example of the invention as applied to a 6000 series aluminum alloy such as 6061.

A two inch thick bar of 6061 aluminum alloy is solution treated within the standard solution temperature range of 970° F. to 1000° F. and rapidly cooled to maintain the precipitate in solution. The alloy is then overaged above its normal aging temperature (for example, 750° F. for 8 hours) to produce coarse precipitates.

The overaged alloy is plastically deformed a minimum of about 40% at a temperature above its recrystallization temperature but below its solvus temperature in the range of 705° F. to 940° F. The deformation should be accomplished rapidly at conventional rolling speeds or faster, and should be done at a sufficient rate to retain at least some of the strain energy at the end of the deformation step.

Recrystallization of the deformed alloy to a fine grain structure is accomplished by holding it at a temperature in the range of 705° F. to 1005° F. for about ½ to 4 hours.

From the above examples, one skilled in the art can readily develop appropriate heat treatment and plastic deformation schedules for any precipitation hardening aluminum alloy based upon standard solution treating and precipitation hardening treatments. Table 1 below, abstracted from "Metals Handbook", vol. 2, 8th edition, p. 272, American Society for Metals, gives these standard treatments for many aluminum alloys, except for alloys 7049 and 7050 for which estimated values are given.

TABLE I

STANDARD HEAT TREATMENT RANGES OF WROUGHT ALUMINUM ALLOYS

| Alloy | Solution Temperature (F) | | Precipitation Hardening Treatment Time (hr) | Temperature (F) |
|---|---|---|---|---|
| 2014 | 925 to 945 | | 9 to 19 | 310 to 350 |
| 2018 | 940 to 960 | | 5 to 11 | 330 to 460 |
| 2020 | 950 to 970 | | 17 to 19 | 310 to 330 |
| 2024 | 910 to 930 | | 17 to 18 | 370 to 380 |
| 2218 | 940 to 960 | | 5 to 11 | 330 to 460 |
| 2219 | 985 to 1005 | | 9 to 19 | 340 to 385 |
| 2618 | 970 to 990 | | 19 to 21 | 385 to 395 |
| 4032 | 940 to 970 | | 9 to 11 | 330 to 350 |
| 6053 | 960 to 985 | | 7 to 19 | 310 to 360 |
| 6061 | 970 to 1000 | | 7 to 19 | 310 to 360 |
| 6062 | 970 to 1000 | | 7 to 19 | 310 to 360 |
| 6063 | 970 to 1000 | | 7 to 19 | 310 to 360 |
| 6066 | 970 to 1000 | | 7 to 19 | 310 to 360 |
| 6151 | 960 to 980 | | 9 to 19 | 310 to 350 |
| 7049 | 860 to 930 | | 23 to 28 | 240 to 260 |
| 7050 | 860 to 930 | | 23 to 28 | 240 to 260 |
| 7075 | 860 to 930 | | 23 to 28 | 240 to 260 |
| 7076 | 860 to 880 | | 13 to 15 | 270 to 280 |
| 7079 | 820 to 880 | | 5 days + 48–50 hrs. | room temperature 230 to 250 |
| | | or | 6–10 days + 23–28 hrs. | 190 to 200 240 to 260 |
| 7178 | 860 to 880 | | 23 to 28 | 240 to 260 |

Material which has been previously solution treated by the supplier can be directly overaged without repeating the solution treatment. Also, material which has been solution treated and then given a precipitation hardening treatment can be directly overaged without requiring an additional solution treatment to redissolve the fine distribution of precipitates.

The term precipitation hardening refers to precipitates developed at times and temperatures which give the alloy optimum strength properties, such as shown in Table I. The term overaging refers to precipitates developed at longer times and/or higher temperatures than used for precipitation hardening.

The relation between time and temperature for age hardening aluminum alloys is also well known in the art. For example, low aging temperatures require longer hold times to accomplish equivalent amounts of aging as can be accomplished at high aging temperatures for shorter hold times. Likewise, the hold time for solution treatment is a function of the hold temperature, although within a narrower temperature range.

The solvus temperature is the temperature at which the precipitating elements in the alloy begin to dissolve into the solid, or approximately the minimum solution temperature shown in Table I. For the purpose of this invention, 900° F. is below the solvus temperature for all the 2000 series alloys. For the 6000 series alloys, 940° F. is below the solvus temperature, and for the 7000 series, 800° F. is below the solvus temperature.

It is also known to the artisan that the recrystallization temperature is related to the amount of plastic strain (mechanical work or cold work) introduced into the lattice. For severely worked aluminum alloys, the minimum recrystallization temperature is over 600° F. Likewise, the amount of mechanical work of the alloy required to permit recrystallization varies depending upon factors such as the recrystallization temperature and the time at the recrystallization temperature. For practicing this invention, the amount of mechanical work, as measured by reduction in cross-sectional area, should be over 40%.

This invention can be incorporated into standard metal forming operations such as rolling, forging, drawing, and extruding by modifying the schedule to conform to the requirements of the invention. For example, in rolling mills for fabricating plate, sheet, and bar, the stock can be overaged to provide a coarse precipitate, and then rolled at the proper temperature and percent reduction to provide the deformation necessary to obtain a fine grain. In forging operations, the forging blanks can be performed as may be necessary, overaged to provide the coarse precipitate, and then plastically deformed during the forging operation.

After the material has been plastically deformed it can be either cooled to a lower temperature prior to recrystallization or heated immediately to the recrystallization temperature while it is still hot. However, for large sections which are slow to heat, the material should not be cooled, but should be heated directly to the recrystallization temperature so as to avoid a slow reheating operation.

Numerous variations and modifications may be made without departing from the present invention. Accordingly, it should be clearly understood that the form of the present invention described above is illustrative only and is not intended to limit the scope of the present invention.

What is claimed is:

1. An improvement in a method of imparting a fine grain structure to an aluminum alloy having a precipitating constituent, said method having steps of:

providing an aluminum alloy having a precipitating constituent;

dissolving at least some of said precipitating constituent in said alloy by heating said alloy to a solid solution temperature;

cooling said alloy to a temperature below said solid solution temperature;

overaging said alloy at an overaging temperature to form precipitates;

plastically straining said alloy; and recrystallizing said alloy by heating it above the minimum recrystallization temperature, whereby said precipitates form nuclei for the recrystallization and controlled growth of a fine grain structure;

said improvement being characterized in that said step of plastically straining said alloy comprises:

heating said alloy to a temperature in the range above said overaging temperature and below said alloy's solvus temperature and reducing its cross-sectional area a total of 40% minimum at a sufficiently high rate to introduce strain energy into said alloy so that complete recovery of said alloy does not occur.

2. The improvement as claimed in claim 1, wherein heating said alloy for said recrystallizing step is accomplished while said alloy is still hot from said plastic straining step.

3. The improvement as claimed in claim 1, wherein said alloy is cooled to below said minimum recrystallization temperature after said step of plastically straining and before said step of recrystallizing said alloy.

4. The method as claimed in claim 1 wherein said step of reducing its cross-sectional area comprises passing said alloy between a pair of rolls in a rolling mill.

5. The method as claimed in claim 1, wherein said step of reducing its cross-sectional area comprises a forging operation.

* * * * *